US007387357B2

(12) United States Patent
Toh et al.

(10) Patent No.: US 7,387,357 B2
(45) Date of Patent: Jun. 17, 2008

(54) CALIBRATION METHOD FOR PRINTING APPARATUS

(75) Inventors: Chee-Wah See Toh, Singapore (SG); Fei Guo, Singapore (SG); Ling-Hwee Ong, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 514 days.

(21) Appl. No.: 11/205,613

(22) Filed: Aug. 16, 2005

(65) Prior Publication Data

US 2007/0040861 A1 Feb. 22, 2007

(51) Int. Cl.
*B41J 29/393* (2006.01)

(52) U.S. Cl. ..... 347/19; 347/37

(58) Field of Classification Search ..... 347/19, 347/37

See application file for complete search history.

(56) References Cited

U.S. PATENT DOCUMENTS 4,463,435 A 7/1984 Cavill
4,789,874 A 12/1988 Majette
5,995,713 A 11/1999 Lee
6,464,319 B1 * 10/2002 Teshigawara et al. ..... 347/19
7,068,296 B2 * 6/2006 Hayashi et al. ..... 347/243
2004/0100514 A1 5/2004 Lopez
2004/0227781 A1 11/2004 Kaburagi

* cited by examiner

*Primary Examiner*—Thinh H Nguyen

(57) ABSTRACT

A calibration method for a printing apparatus is disclosed. The printing apparatus has at least one ink pen and a carriage for scanning the ink pen across a printing region. The calibration method includes: (a) printing a test pattern across a print medium at a constant carriage velocity; (b) optically scanning the printed test pattern to obtain a sensor signal thereof; (c) setting the carriage velocity so that there are acceleration, deceleration and constant velocity printing regions; (d) printing the same test pattern; (e) optically scanning the subsequent test pattern to obtain a sensor signal thereof; (f) comparing the sensor signals of the two test patterns to determine ink dot placement errors; and (g) calibrating time-delay compensation values based on the dot placement errors.

9 Claims, 5 Drawing Sheets

CALIBRATION METHOD FOR PRINTING APPARATUS

FIELD OF THE INVENTION

The present invention relates generally to methods for correcting errors during printing.

BACKGROUND

Commercial printing apparatuses such as computer printers, plotters, copiers, and facsimile machines employ inkjet technology for producing images and text on print media. A conventional inkjet printer implements one or more inkjet cartridges, called "pens" by those in the art, to eject droplets of ink onto a print medium, e.g. paper. Each pen has a printhead formed with a plurality of small nozzles through which the ink droplets are ejected. The pens are typically mounted on a movable carriage. To print an image or text, the carriage traverses back and forth across the print medium in a direction traverse to the moving direction of the print medium. Each passage or scan of the carriage across the print medium prints a "swath." For each swath, the nozzles are fired to print groups of dots. After each swath is printed, the print medium is advanced relative to the carriage so that a subsequent swath may be printed. By repetition of this process, a completed printed page may be produced.

When the carriage is scanned across the paper, the carriage velocity is not constant. There are acceleration and deceleration ramps at the ends of a scan. In recent trend to downsize the printing apparatus, the so-called "printing on the ramp" has been introduced. In printing on the ramp, printing is performed during the acceleration and deceleration ramps. One advantage of this printing method is that the time required to print a swath is reduced, thereby improving throughput. In addition, the required traversing distance of the carriage is reduced, thereby enabling size reduction for the printing apparatus. However, printing during acceleration and deceleration ramps introduces ink dot placement errors (DPE) in the scanning direction of the carriage. These errors have to be compensated in order to improve print quality. Because each inkjet printing apparatus is made up of many different parts and each part is subjected to its own manufacturing imperfection, the amount of compensation would vary among different apparatuses. Thus, there exists a need for a method of printing during acceleration and deceleration of the carriage with compensation for errors in ink dot placement.

SUMMARY

The present invention provides a calibration method for a printing apparatus which has at least one ink pen and a carriage for scanning the ink pen across a printing region. The calibration method includes: (a) printing a test pattern across a print medium at a constant carriage velocity; (b) optically scanning the printed test pattern to obtain a sensor signal thereof; (c) setting the carriage velocity so that there are acceleration, deceleration and constant velocity printing regions; (d) printing the same test pattern; (e) optically scanning the subsequent test pattern to obtain a sensor signal thereof; (f) comparing the sensor signals of the two test patterns to determine ink dot placement errors; and (g) calibrating time-delay compensation values based on the dot placement errors.

The objects and advantages of the present invention will become apparent from the detailed description when read in conjunction with the drawings.

DETAILED DESCRIPTION

The present invention is directed to a printing operation in a printing apparatus having at least one ink pen and a carriage for scanning the ink pen across a printing region, wherein printing occurs during the acceleration and deceleration ramps of the carriage. The present invention recognizes that printing during acceleration and deceleration ramps causes the ink drops to land at varying distances from the intended locations, i.e. dot placement errors (DPE), and that such errors should be compensated to improve printing quality.

Figure 1:
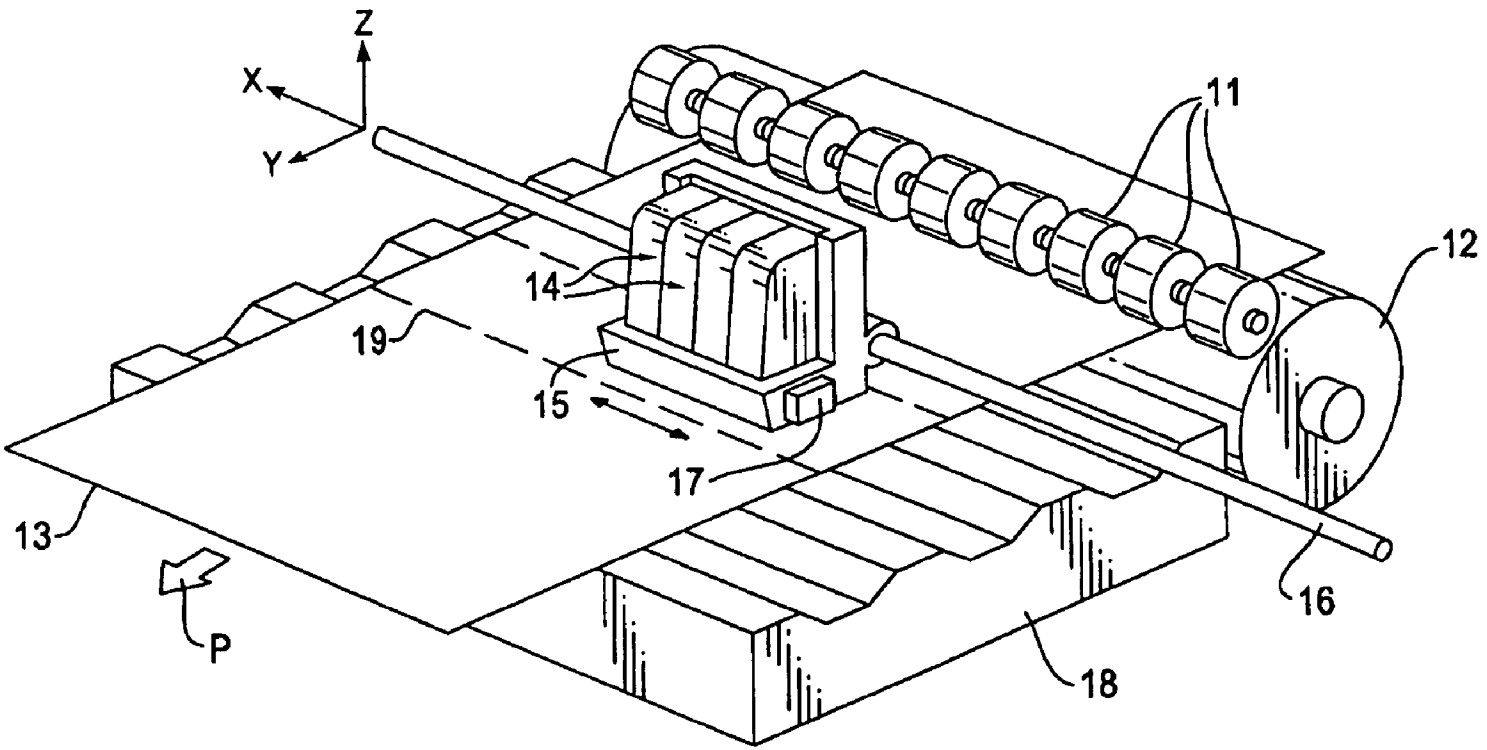
FIG. 1 shows a sectional view of an exemplary inkjet printer for which the present invention is applicable.

FIG. 1 shows a sectional view of an exemplary inkjet printer 10 for which the present invention is applicable. The term "printer" is intended to encompass all imaging apparatuses that utilize inkjet printing technology, such as computer printers, copiers, facsimile machines, and graphic plotters. The inkjet printer 10 includes pinch rollers 11 and feed roller 12 for advancing a print medium 13, e.g. paper, along a media path P in a Y direction. A plurality of ink pens 14 are mounted on a carriage 15, which is adapted for reciprocal motion along a slide rod 16. The slide rod 16 extends in an X direction that is traverse to the moving direction Y of the paper. An optical sensor 17 is mounted on the carriage. A platen 18 is provided below the carriage 15 for supporting the print medium during printing. A print zone 19 is defined by the reciprocating carriage 15 and the platen 18. Each pen 14 has a printhead (not shown) formed with a plurality of small nozzles. During printing, the nozzles are activated to eject droplets of ink onto the print medium (this is also called "ink firing" in the art). Each scan or passage of the carriage 15 across the print medium prints a swath of ink dots. After each swath is printed, the print medium is advanced relative to the carriage 15 so that a subsequent swath may be printed. By repetition of this process, a completed printed image may be produced.

Figure 2:
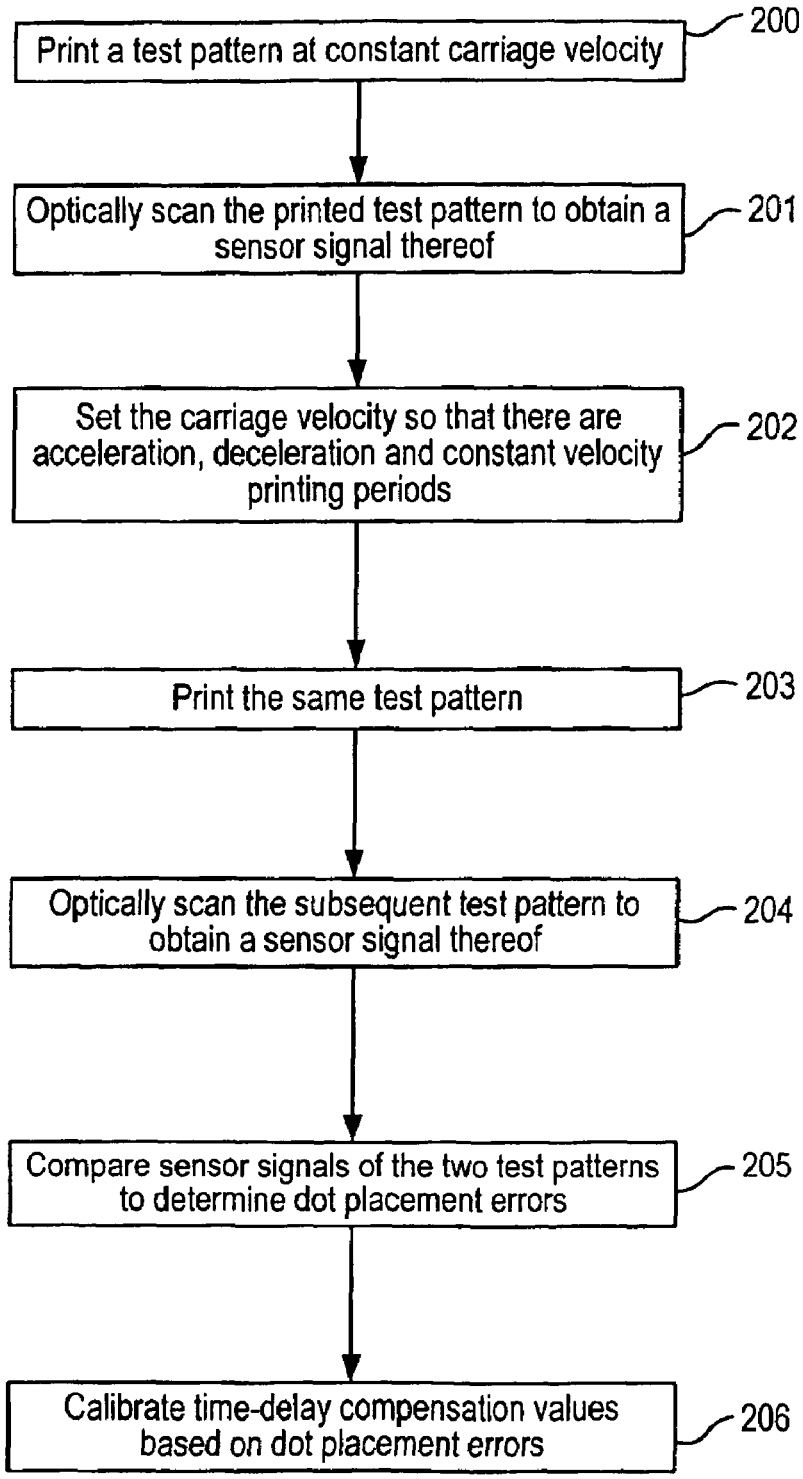
FIG. 2 is a flowchart illustrating a method of calibrating compensation values according to an embodiment of the present invention.

FIG. 2 is a flowchart illustrating a method of calibrating compensation values according to an embodiment of the present invention. This method is carried out in the inkjet printer shown in FIG. 1. At step 200, a test pattern is printed across a printing region on a print medium at a constant carriage velocity. At step 201, the printed test pattern is optically scanned using the carriage-mounted optical sensor 17 to obtain a sensor signal thereof. Next, at step 202, the carriage velocity is set so that there are acceleration, deceleration and constant velocity printing regions. The constant velocity in step 202 is set to be the same as the constant velocity in step 200. At step 203, the same test pattern is printed again using the adjusted velocity setting. At step 204, the subsequent test pattern is optically scanned to obtain a sensor signal thereof. The sensor signals of the two test patterns are compared at step 205 to determine ink dot placement errors. At step 206, time-delay compensation values are calibrated based on the ink dot placement errors.

Figure 3:
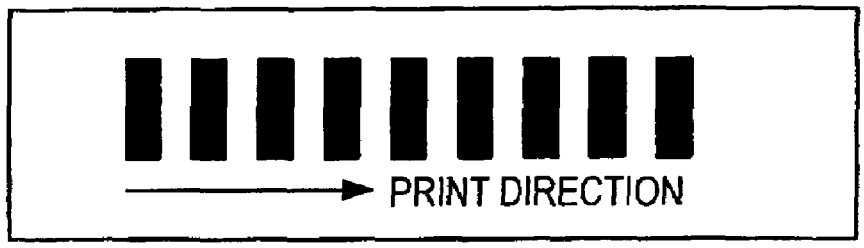
FIG. 3 illustrates an exemplary test pattern that is used in the calibration method.
Figure 4:
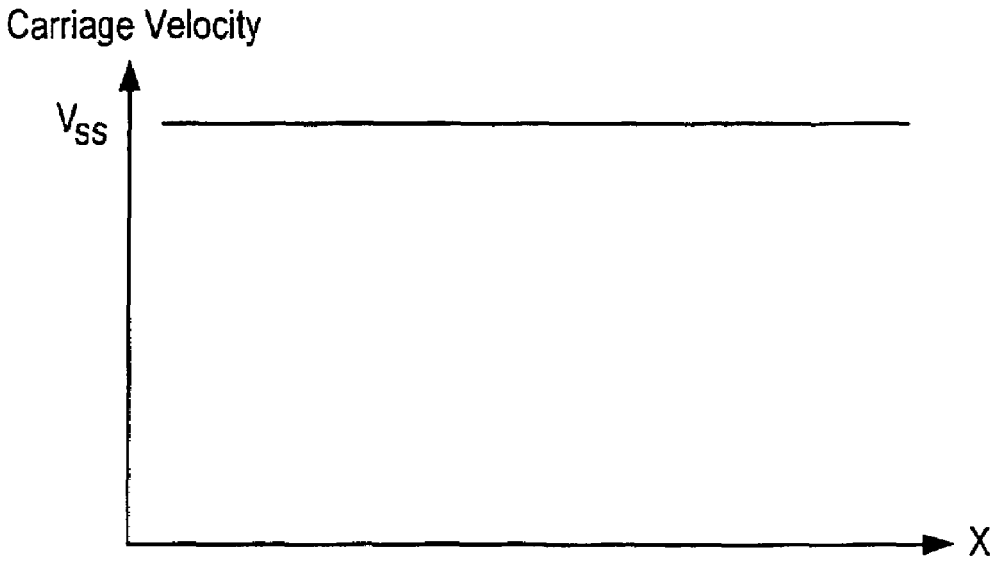
FIG. 4 is a graph depicting a predetermined constant carriage velocity.
Figure 5:
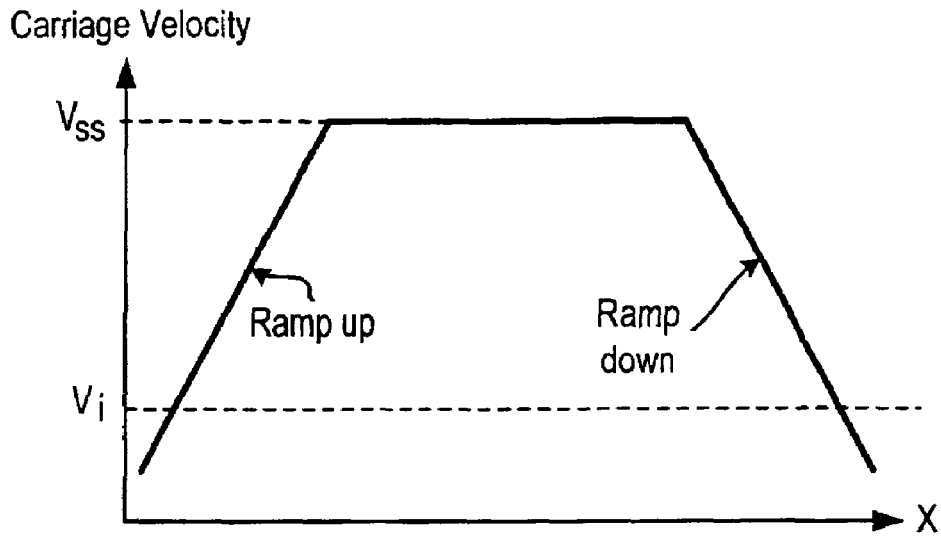
FIG. 5 is a graph depicting a carriage velocity profile with a constant velocity period between acceleration and deceleration ramps.

FIG. 3 illustrates an exemplary test pattern composed of a row of printed blocks that may be used in the calibration method of FIG. 2. This test pattern is printed by scanning the carriage across the print medium in one direction. It should be understood by those skilled in the art that this test pattern is only exemplary. Test patterns with markings other than blocks are possible for the same calibration purpose FIG. 4 illustrates a graph of carriage velocity versus carriage position when printing the test pattern at a predetermined constant carriage velocity $V_{ss}$. As can be seen from FIG. 4, the graph is a straight line because the carriage velocity remains substantially constant as the carriage moves along the scanning axis (i.e., X direction). This test pattern will be referred to as "reference pattern" from hereon. FIG. 5 graphically illustrates the carriage velocity profile used for printing the subsequent test pattern. This carriage velocity profile represents the expected carriage velocity profile during real life printing. The subsequent test pattern will be referred to as "print-on-ramp pattern" from hereon. The print-on-ramp pattern may be printed as a separate row after the print medium has been advanced forward, or printed using nozzles at different printhead position, so that the print-on-ramp pattern does not overlap with the reference pattern. As shown in FIG. 5, during the constant carriage velocity period, the carriage velocity is set at $V_{ss}$, which is the same as the constant velocity used in printing the reference pattern. The starting carriage velocity and the ending carriage velocity are the same and set at $V_i$. Alternatively, the starting velocity and the ending velocity may be set at different values.

Determining DPE Values

As discussed above for FIG. 2, after each test pattern is printed, each test pattern is optically scanned by the carriage-mounted optical sensor. The sensor signals from the two test patterns are then compared to determine ink dot placement errors (DPE). One method of determining DPE involves detecting the positions of the printed blocks in the reference pattern and the positions of the printed blocks in the print-on-ramp pattern, then comparing the relative positions of the blocks. This DPE determination can be done by analyzing the sensor signals output from the optical sensor using digital signal processing techniques.

Figure 6:
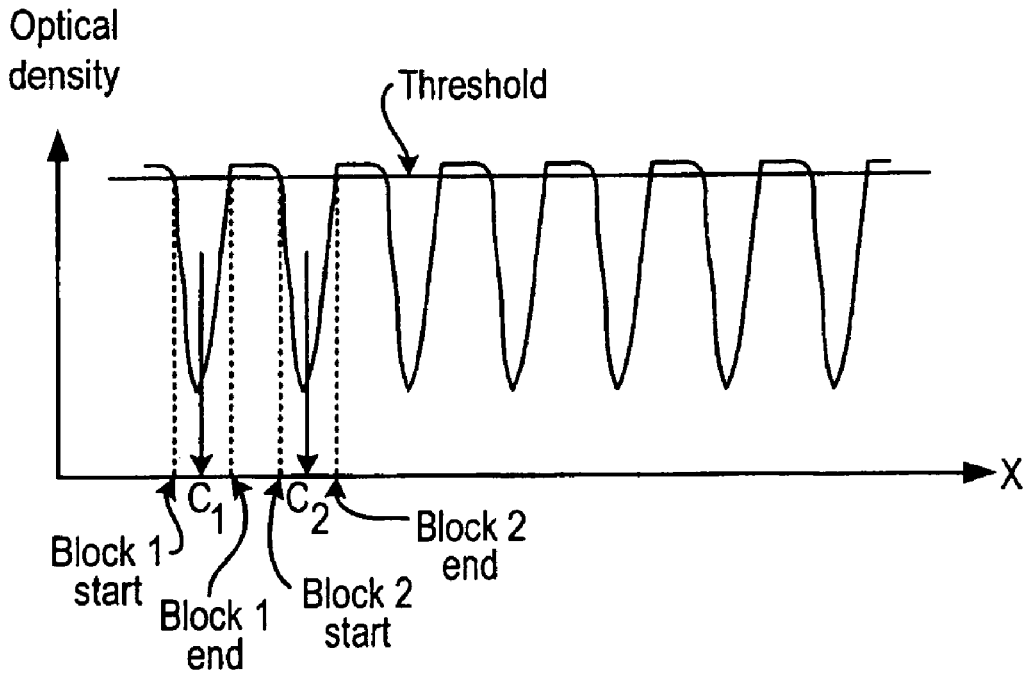
FIG. 6 graphically illustrates the sensor signal output from scanning an optical sensor across the test pattern of FIG. 3.

One exemplary processing technique for detecting the positions of the printed blocks is to find the centroid (i.e. center) of each block. The centroids can be found by analyzing the optical signal to determine the 'center of gravity' of each block. FIG. 6 graphically illustrates the sensor signal output from the optical sensor when the optical sensor is scanned across the test pattern of FIG. 3. In FIG. 6, $c_1$ corresponds to the centroid location of the first printed block ("block 1") and $c_2$ corresponds to the centroid location of the second printed block ("block 2"). Once the centroids are found, the relative offsets between the centroids of the print-on-ramp pattern and the centroids of the reference pattern are then computed. The calculated offsets represent DPE values. Referring to FIG. 6, by calculating the difference between $c_1$ of the print-on-ramp pattern and $c_1$ of the reference pattern, the relative offset of block 1 is determined. Similarly, by calculating the difference between $c_2$ of the print-on-ramp pattern and $c_2$ of the reference pattern, the relative offset of block 2 is determined. For example, suppose that $c_1$ for the reference pattern is 301.65 and $c_1$ for the print-on-ramp pattern is 300.10, in units of 1/600 dpi, then:

$$DPE=300.10-301.65=-1.55$$

This means that, during printing on the acceleration ramp, the first printed block (block 1) is displaced in the negative X direction by 1.55 dot row of 600 dpi.

It will understood by those skilled in the art that other signal processing techniques for determining DPE values may be used. For example, it is possible to apply an artificial horizontal offset to the print-on-ramp signal, then for each block compute the difference (or mean squared difference) with respect to the reference signal. This process is repeated over a range of offset values to determine the one that yields the smallest difference. This determined offset value is the DPE value.

Computing Time-Delay Compensation Values

Once the DPE values are determined, the time-delay compensation values can be computed according to the following simple equation:

$$\text{Time delay compensation}=-DPE/V_{carriage}$$

where $V_{carriage}$ is the carriage velocity associated with printing the print-on-ramp pattern, and more specifically, the carriage velocity when a block is printed. For example, suppose that the DPE value for block 1 is −1.55 (in units of 1/600) and the carriage velocity is 30.5 ips (inch per second) when block 1 is printed, then $$\text{Time delay compensation}=-(-1.55)(1/600)/30.5=84699.45\text{ ns}$$

For the sake of simplicity, the above simple equation ignores the fact that the carriage velocity varies during printing on the acceleration and deceleration ramps, but the variation is sufficiently small over the width of each printed block so that it can be ignored. It will be understood by those skilled in the art that other more complicated equations may be used to calculate the time delay compensation.

Computing Compensation Values Using Carriage Servo Profile

In another embodiment of the present invention, the actual carriage velocity and the carriage position during the printing of the print-on-ramp pattern are detected and stored. This detection may be obtained by providing a strip encoder parallel to the slide rod 16 shown in FIG. 1. Such strip encoder is known and is disclosed, for example, in U.S. Pat. No. 4,789,874 (assigned to the common assignee hereof and incorporated herein by reference). The detected data is used to generate a carriage servo profile (speed vs. position). The actual carriage velocity is then used in the computation of the time delay compensation values. By using the actual carriage velocity, the accuracy in the computation of DPE values is further increased.

Figure 7:
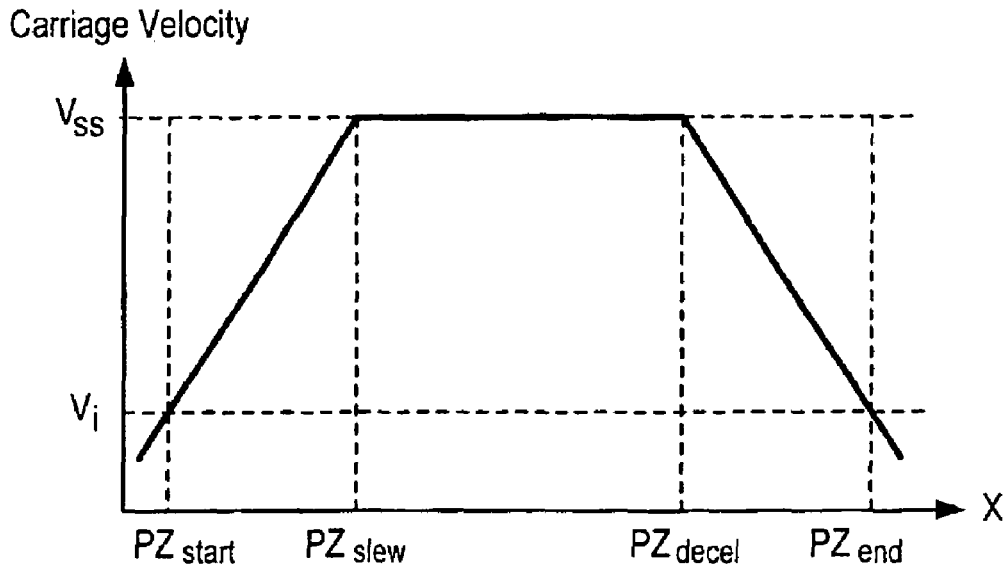
FIG. 7 graphically illustrates the carriage servo profile generated from measuring the actual carriage velocity during the printing of a test pattern according to another embodiment of the present invention.

In another embodiment, after the carriage servo profile is generated, the print zone information is extracted from the carriage servo profile and stored. FIG. 7 graphically illustrates the carriage servo profile generated from measuring the actual carriage velocity during the printing of the print-on-ramp pattern. In FIG. 7, $PZ_{start}$ represents the start of the printing area, i.e., where printing starts, $PZ_{slew}$ is the location where steady carriage velocity begins, $PZ_{dec}$ is the location where deceleration begins, and $PZ_{end}$ is the location where printing ends. The width of the printing area is defined by $PZ_{start}$ and $PZ_{end}$. Because compensation is more critical in the acceleration and deceleration zones, the computation of the time delay compensation values may be limited to these zones. Thus, from the print zone information shown in FIG. 7, only those printed blocks of the print-on-ramp pattern that fall between $PZ_{start}$ and $PZ_{slew}$ are analyzed for acceleration compensation, and only those printed blocks that fall between $PZ_{slew}$ and $PZ_{end}$ are analyzed for deceleration compensation. It should be understood by those skilled in the art that the zones of interest may be extended slightly beyond the acceleration and deceleration zones to increase the accuracy of the analysis.

Once the time delay compensation values are computed, these values are used to adjust the timing of ink firing during real life printing. This adjustment is done so as to compensate for ink dot placement errors arising from printing during carriage acceleration and deceleration ramps.

The calibration method discussed above may be provided in the form of a program written in computer code language for causing the printer controller to execute the steps of the method. Furthermore, the program may be stored in a computer-readable storage medium in the printer controller so that it can be read by the printer controller. The program is initialized when a new printer is powered up or immediately after an ink pen has been replaced. The printer controller may take the form of a dedicated processor or one or more application-specific integrated circuits (ASICs) that provide computing and data processing capabilities for operating and controlling various components of the printer.

One advantage of the calibration method of the present invention is that it does not just compensate for DPE due to carriage velocity variation. Carriage velocity variation is only one contributing factor to DPE. There are other factors, such as carriage dynamics, carriage rotation, etc., that also contribute to DPE during acceleration and deceleration ramps. The calibration method of the present embodiment(s) takes into account all of these contributing factors and can accurately extrapolate the required compensation values. Another advantage is that this calibration method is insensitive to pen-to-paper spacing variances in the scanning direction of the carriage. Furthermore, the compensation values obtained from this calibration method are specific to each printer. Because each printer is subject to its own manufacturing imperfection, the amount of compensation required varies for different printers. Thus, it is advantageous to have an automatically customized compensation as provided by the present invention.

Although the invention has been described with reference to the embodiments described above, it will be understood by those skilled in the art that various changes may be made and equivalents may be substituted for various elements of the embodiments without departing from the scope of the invention as set forth in the appended claims.

What is claimed is:

1. A calibration method for a printing apparatus which has a carriage for scanning at least one ink pen across a printing region, said method comprising:

printing a first test pattern across a print medium using a constant carriage velocity;

optically scanning the printed test pattern to obtain a sensor signal thereof;

setting the carriage velocity so that there are acceleration, deceleration and constant velocity printing regions;

printing a second test pattern using the set carriage velocity, the second test pattern being the same as the first test pattern;

optically scanning the second test pattern to obtain a sensor signal thereof;

comparing the sensor signals of the first and second test patterns to determine ink dot placement errors; and calibrating time-delay compensation values based on the ink dot placement errors.

2. The calibration method of claim 1, wherein setting the carriage velocity further comprises setting the carriage velocity for the constant velocity printing region to be the same as the constant carriage velocity used in printing the first test pattern.

3. The calibration method of claim 1, wherein each of the first test pattern and the second test pattern comprises a row of printed blocks.

4. The calibration method of claim 3, wherein comparing the sensor signals further comprises:

finding the centroid locations of the printed blocks in the first and second test patterns; and comparing the centroid locations of the second test pattern relative to the centroid locations of the first test pattern to determine dot placement errors.

5. The calibration method of claim 1, wherein calibrating time-delay compensation values further comprises applying the following equation:

$$\text{Time delay compensation} = -DPE/V_{carriage}$$

where DPE is dot placement error and $V_{carriage}$ is the carriage velocity associated with printing the second test pattern.

6. The calibration method of claim 5 further comprising:

detecting the actual carriage velocity and carriage position when the second test pattern is being printed, and using the detected carriage velocity as $V_{carriage}$ in the calibration of time-delay compensation.

7. The calibration method of claim 1 further comprising:

detecting the actual carriage velocity and carriage position when the second test pattern is being printed, and applying the detected carriage velocity in the calibration of the time-delay compensation values.

8. A method for printing in a printing apparatus which has at least one ink pen for ejecting ink droplets onto a print medium and a carriage for scanning the ink pen across a printing region, said method comprising:

printing a test pattern across a print medium using a constant carriage velocity;

optically scanning the printed test pattern to obtain a sensor signal thereof;

setting the carriage velocity so that there are acceleration, deceleration and constant velocity printing regions;

printing the same test pattern using the set carriage velocity;

optically scanning the subsequent test pattern to obtain a sensor signal thereof;

comparing the sensor signals of the two test patterns to determine ink dot placement errors;

calibrating time-delay compensation values based on the ink dot placement errors; and performing a printing operation using the time-delay compensation values, wherein said printing operation is performed during acceleration, deceleration and constant-velocity movement of the carriage.

9. A computer-readable medium comprising instructions for:

printing a test pattern across a print medium using a constant ink pen velocity;

optically scanning the printed test pattern to obtain a sensor signal thereof;

setting the ink pen velocity so that there are acceleration, deceleration and constant velocity printing regions;

printing the same test pattern using the set ink pen velocity;

optically scanning the subsequent test pattern to obtain a sensor signal thereof;

comparing the sensor signals of the two test patterns to determine ink dot placement errors; and calibrating time-delay compensation values based on the ink dot placement errors.

* * * * *